United States Patent [19]

Bleeker

[11] 4,030,788

[45] June 21, 1977

[54] NON-EXPOSED DRAWER LOCK

[75] Inventor: Raymond A. Bleeker, Grand Rapids, Mich.

[73] Assignee: Westinghouse Electric Corporation, Pittsburgh, Pa.

[22] Filed: Oct. 28, 1975

[21] Appl. No.: 626,168

[52] U.S. Cl. ..... 312/333; 70/85; 312/319

[51] Int. Cl.[2] ..... A47B 88/00

[58] Field of Search ..... 70/85, 93; 312/333, 312/204, 219, 319, 330, 350; 292/277

[56] References Cited

UNITED STATES PATENTS

| | | | |
|---|---|---|---|
| 2,257,741 | 10/1941 | Gray | 70/85 |
| 3,381,992 | 5/1968 | Friesen | 292/87 |
| 3,490,823 | 1/1970 | Neu et al. | 312/330 |
| 3,597,947 | 8/1971 | Solow | 70/93 |
| 3,850,463 | 11/1974 | Hawkins | 312/333 |
| 3,918,752 | 11/1975 | Leone et al. | 312/333 |

FOREIGN PATENTS OR APPLICATIONS

| | | | |
|---|---|---|---|
| 1,009,109 | 5/1957 | Germany | 312/330 |

*Primary Examiner*—Paul R. Gilliam
*Assistant Examiner*—Kenneth J. Dorner
*Attorney, Agent, or Firm*—B. R. Studebaker

[57] ABSTRACT

A non-exposed drawer lock for locking a drawer to its surrounding case. The drawer front is flush with the edge of the work surface with the lock completely hidden from view. A spring urged slidable locking bar is mounted to the drawer case which permits the drawer to be opened slightly while still in a locked configuration thus exposing the lock to thereby permit the drawer to be unlocked and opened completely.

8 Claims, 7 Drawing Figures

NON-EXPOSED DRAWER LOCK

BACKGROUND OF THE INVENTION

Over the last several decades the work force has been rapidly changing from one which worked with machines and tools, the so-called blue collar work force, to one of principally technical, clerical and administrative functions, the so-called work force. With this change in work force character has come the increased need for office type work space. In almost every instance this kind of labor requires an office type work setting including a desk for the preformance of the assigned task. This can be either a conventional desk or a modern work surface which, in either instance, generally requires some type of drawer system either located within a conventional desk or hanging below the work surface. Most of these white collar workers spend many hours a day in their work area and some consideration must be given to the esthetics of that work area. In general, one or more of the drawers connected to a desk or work surface will have the ability to be locked and in most instances the exposed lock and keyhole appear somewhere on the face of that drawer somehow detracting from the overall appearance of the modern office furniture system. Designers in some cases have tried to partially conceal the lock in the handle but it is still there to be seen. Other designers have moved the lock to the side of the drawer cabinet or case but this location has two basic disadvantages. The user has to feel for or bend over and look to find the keyhole when it is hidden on the side of the drawer case and also with the side mounted drawer locks the drawers cannot be used butted side-by-side and retain their lock function. Since in some instanes a means for locking the work surface or desk drawers is essential, completely eliminating the lock for esthetic purposes is not a solution to the problem. The proper solution would seem to be providing a drawer system which gives the appearance of having no lock but yet is in fact lockable when such functon is either necesssary or desirable.

SUMMARY OF THE INVENTION

This invention relates to drawer locking mechanisms and more particularly to a drawer locking system which is completely hidden from view when the drawer is in a closed configuration.

The drawer locking system of this invention when unlocked will open and close like any normal drawer unit but when the drawer is in a locked configuration the drawer will only open a short distance, only far enough to expose the lock located in the top edge of the drawer front panel. With the lock now exposed the lock may be released allowing the drawer to open the balance of its travel. This partial opening to expose the lock while in a locked position is accomplished by a traveling lock bar which permits limit drawer travel while in a locked configuration.

This invention provides in combination a drawer slidable therein and locking means locking the drawer to the case which locking means permits limited relative movement between the drawer and said drawer case while the lock is operative. The locking means includes a locking bar mounted for limited reciprocal or sliding motion with respect to the drawer case and which is adapted to interconnect with a lock mounted in the front panel of the drawer. The reciprocal motion of the locking bar is limited by a pair of spaced stops projecting from the locking bar which are adapted to coact with a portion of the drawer case and spring means may be connected between the locking bar and the drawer case to urge the locking bar toward a closed position against a first of the spaced stops with the combination permitting the drawer when in a locked condition to be opened a limited distance against the action of the spring, if one is provided, which distance is limited by the other pair of spaced stops. The desk or work surface top overlies the lock in the front panel of the drawer when the drawer is in a closed position with the lock being uncovered when the drawer is moved to the limited open position thereby rendering the lock accessible for purposes of unlocking the drawer.

BRIEF DESCRIPTION OF THE DRAWING

Many of the attended advantages of the present invention will become more readily apparent and better understood as the following detailed description is considered in connection with the accompanying drawings, in which.

DESCRIPTION OF THE PREFERRED EMBODIMENT

Figure 1:
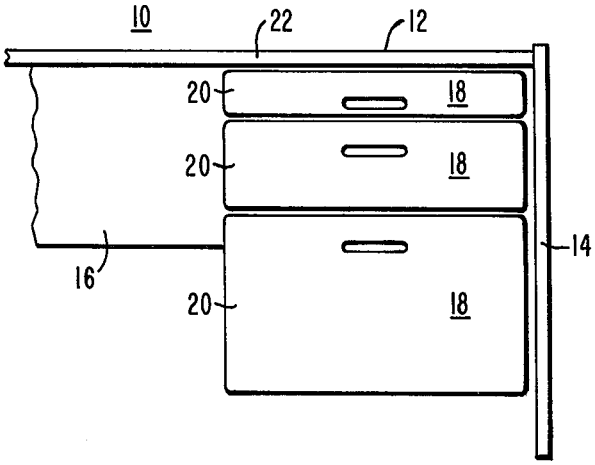
FIG. 1 is a front elevation view of a typical work surface and drawer system.

Referring now in detail to the drawing wherein like reference characters represent like parts throughout the several views, there is illustrated in FIG. 1, a typical modern work surface or desk generally designated 10 which includes a work surface or desk top 12 which may be supported at each end by side or leg panels 14 and generally includes a brace panel or modesty panel 16 spanning the two leg or end panels 14. As will be apparent as the description of the drawer system and non-exposed drawer lock of this invention proceeds, the invention could also be employed with a cantilever mounted work surface, mounted to a wall panel with only one leg or side panel, a conventional knee hole or student type desk or for that matter an executive type desk.

As illustrated in FIG. 1 a plurality of drawer systems 18 constructed and mounted in accordance with the present invention are illustrated as being suspended below the work surface or desk top 12 so that the front face of the drawer front panel 20 of the drawer 21 is flush with or lies in the same plane as the front edge 22 of the desk top 12. Each drawer system 18 includes a drawer case 24 and the drawer case 24 includes a pair of side walls 26, 28 which have on their inner surfaces guide rails 30 which are adapted to receive external side rails 32 on the body or tub portion 33 of drawer 21. A standard ball-bearing drawer glide system could obviously be substituted for the guide rails 30 and the side rails 32. The drawer case 24 may also include a back panel 34 and as illustrated includes a locking mechanism support bar or frame 36 which spans and interconncts the side walls 26 and 28 adjacent the front ends thereof. The drawer case may also include at the upper edges of the side walls 26 and 28 a mounting flange 38 which facilitates the mounting of the drawer case to the underside of the work surface or desk top. The side walls 26 and 28 may also include at their bottom edge mounting flanges 40 which will facilitate the stacking or connecting together of several drawer systems 18 as illustrated in FIG. 1.

Figure 7:
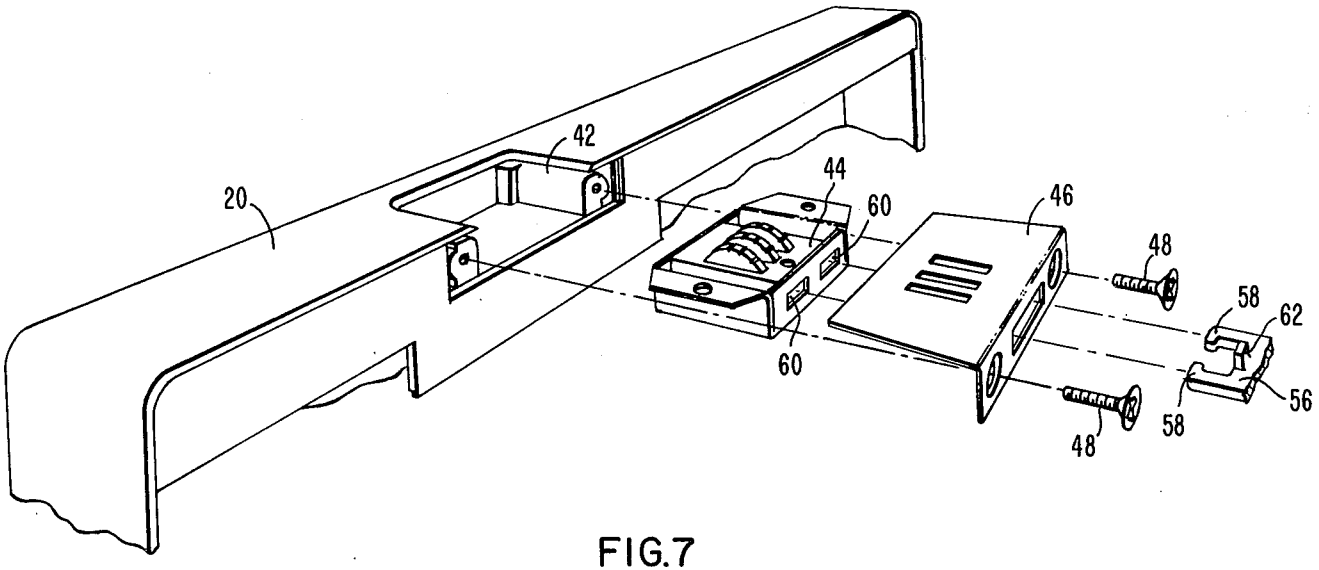
FIG. 7 is an exploded view of a type of drawer lock and a drawer front panel.

The drawer front panel 20 includes at its upper edge, as best seen in Fig. 7, a lock receiving recess 42 which is located substantially centrally of the drawer panel 20 adjacent the inner edge thereof and into which a convention lock 44 is mounted. The lock 44 illustrated may be a conventional combination lock of the SESAMEE type manufactured by the Corbin Cabinet Lock division of Emhart Corporation, Berwin, Connecticut or alternatively, it will be apparent that a key actuated lock would work equally well. The lock 44 is secured in pace by a lock cover plate 46 which may be mounted to the drawer front panel 20 by means of a pair of screws 48.

Figure 4:
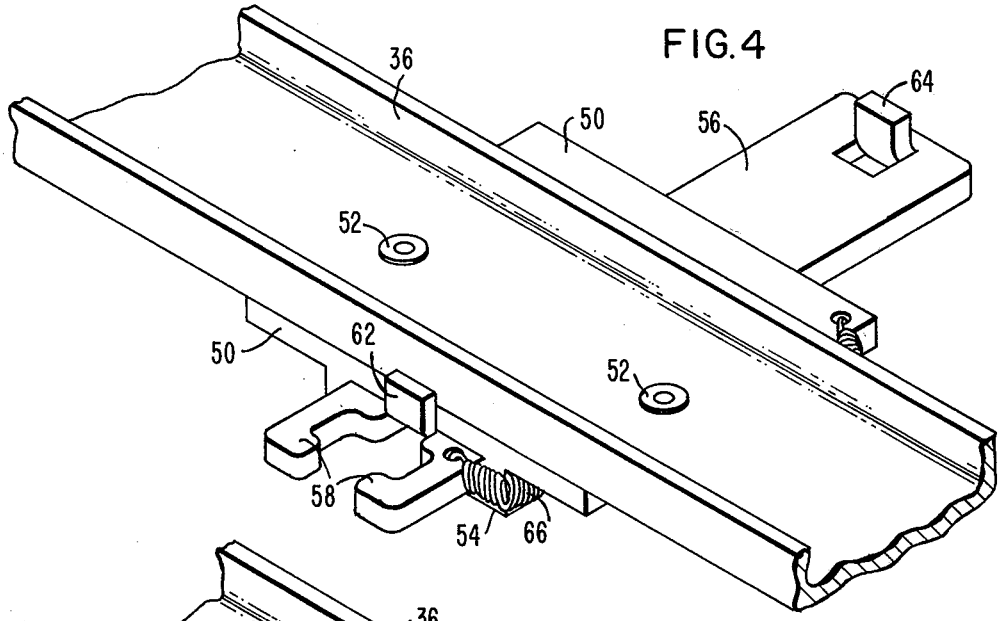
FIG. 4 is an isometric view of the drawer locking mechanism in a closed position.
Figure 5:
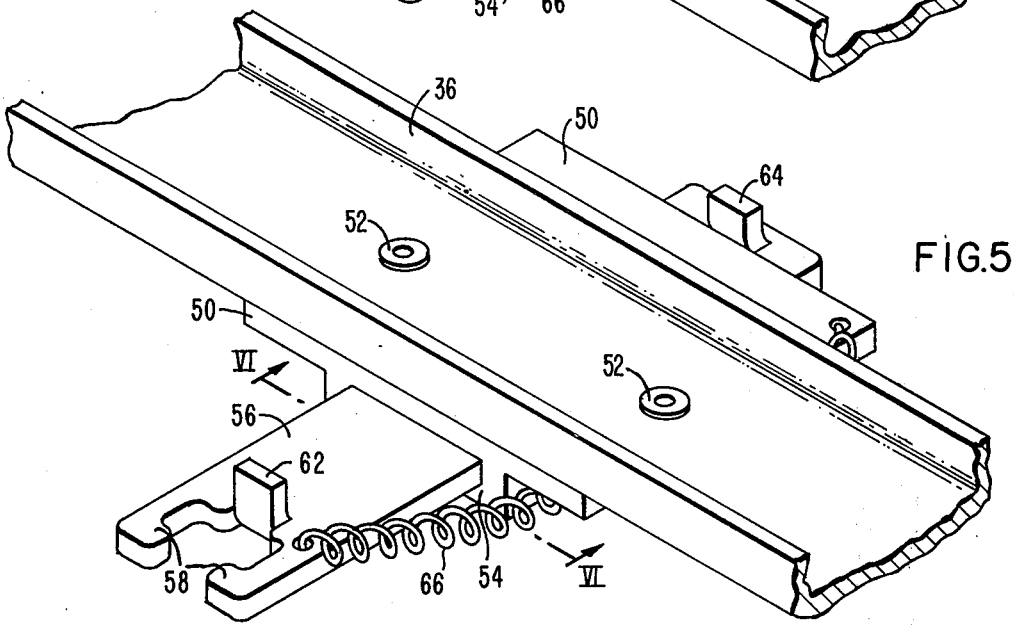
FIG. 5 is an isometric view similar to FIG. 4 with the locking mechanism in is partially open position.
Figure 6:
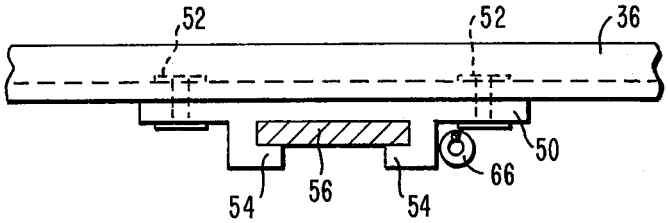
FIG. 6 is a front elevational view, partly in section, of a portion of the drawer locking mechanism.

Referring now to FIGS. 4, 5 and 6, the locking mechanism support bar 36 has mounted thereto near its midpoint, a lock bar guide 50 which may be mounted to the locking mechanism support bar 36 in any suitable manner as for example rivets 52. The lock bar guide includes a pair of inwardly directed flange members 54 which serve as a track or raceway for the traveling lock bar 56. Although as illustrated the lock bar guide and associated lock bar structure is mounted to the locking mechanism support bar 36, it will be apparent that this sturcture could be mounted directly to the underside of a work surface if desired or to the bottom of an upper drawer in a series of stacked drawers. Traveling lock bar 56 has a pair of inwardly directed hook members or projections 58 at the forward end thereof which are adapted to enter the slot 60 in the face of lock 44 and which may be secured by the internal locking mechanisms of the lock 44. It will be apparent that the configuration of the forward end 58 of the traveling lock bar should take whatever form is compatible with the locking mechanism of the selected lock 44. The traveling lock bar further includes a forward upwardly extending stop memeber 62 and a rear upwardly directed stop member 64 the purpose of which will be described hereinafter. A resilient coil spring 66 interconnects the lock bar guide 50 with the traveling lock bar 56. The spring is connected near the rearward end of the lock bar guide 50 and to a point near the front end of the traveling lock bar 56 and urges the traveling lock bar toward a rearward or closed position in the lock bar guide 50. Stop member 62 limits the extent of rearward travel of the traveling lock bar 56 under the influence of spring 66 by striking the front edge of the lock bar guide 50. One of the principal purposes of the spring 66 is to retain the lock bar 56 in a retracted out of the way position when the drawer is in an open unlocked configuration. The spring 66 also aids in retaining the drawer in a closed position when the drawer is locked but it will be apparent that it is not critical to the operation of the non-exposed drawer lock of this invention.

Figure 2:
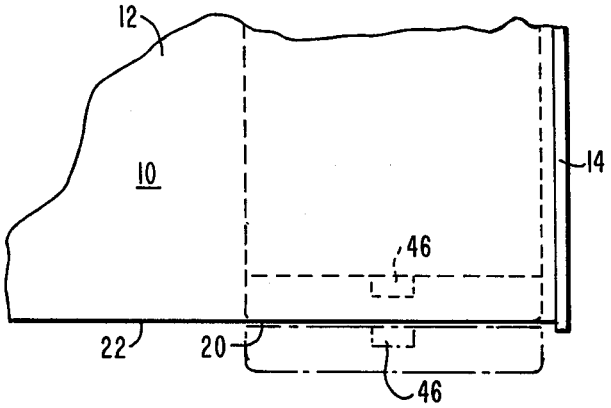
FIG. 2 is a top plan view of a work surface and drawer system constructed in accordance with this invention.
Figure 3:
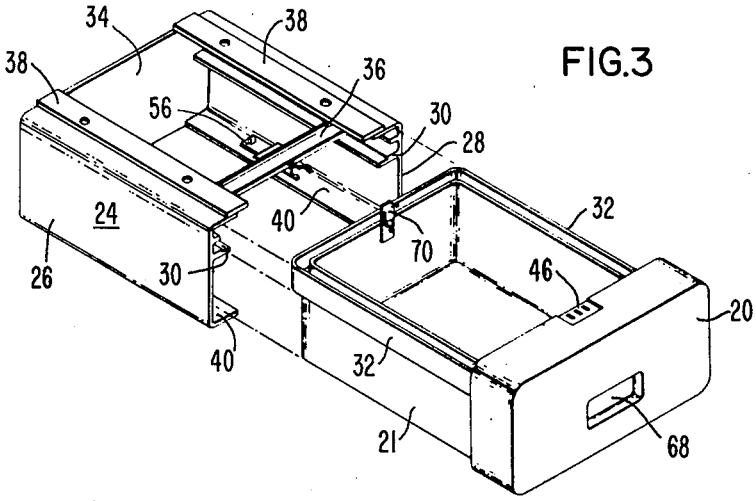
FIG. 3 is an isometric view of a drawer and drawer case constructed in accordance with this invention.

In operation, the drawer case 26 is mounted to the underside of a work surface or desk top 12 so that when the drawer 21 is in a fully closed position the front face of the front panel 20 of the drawer is flush with the front edge 22 of the desk top or work surface 12. The front panel 20 of the drawer includes a recess or opening 68 in the front face thereof which serves as a handle but it will be apparent that any type hardware could be used on the front face of the panel 20 to facilitate opening the drawer. As best seen in FIG. 2, the drawer lock identified by the cover plate 46 is completely hidden from view beneath the work surface 12. When the traveling lock bar hook members or projections 58 are locked into the lock 44 the drawer 21 may still be opened a distance which represents the difference in spacing between the stop members 62 and 64 and the depth of the lock bar guide 50. In other words, when the drawer is in a closed position, the stop 62 abuts the lock bar guide 50 but even in the locked condition the drawer can be opened against the action of spring 66 until the stop 64 abuts the rear edge of the lock bar guide 50. This distance is illustrated in FIG. 2 by hidden lines and illustrates the fact that the drawer may be opened a limited extent while still in a locked condition to render the lock 44 accessible When the lock is deactivated either by combination as required by the lock illustrated in FIG. 7 or by a key if such an alternative lock is selected, upon release of the hook members or projections 57 by the lock 44, spring 66 retracts the traveling lock bar to the position illustrated in FIG. 4 and the drawer is permitted to be opened the balance of its normal travel. To prevent the drawer 21 from being completely withdrawn from the drawer case 24, a conventional flip latch 70 may be employed on the rearward end of the drawer body 32 which will also coact with the locking mechanism support bar 36 to prevent inadvertent withdrawl of the drawer 21 from the guide rails 30.

As will be apparent from the foregoing, the drawer system employing the non-exposed drawer lock of this invention provides a completely hidden drawer lock when the drawer is in its normal closed position. When the lock is not activated, the drawer will operate as any conventional drawer. When the lock is activated, the drawer will open only a limited distance to make the lock available for deactivation at which time the drawer will then be free to travel the remainder of its normal open distance.

I claim:

1. In combination, a drawer case, a drawer including a front panel, slidable in said drawer case and locking means for locking said drawer to said drawer case; said locking means including a locking bar and a lock, said locking bar being mounted on said drawer case for limited reciprocal motion with resect to said drawer case, said lock being mounted in the front panel of said drawer and adapted to interconnect with said locking bar; said locking means permitting limited relative slidable movement between said drawer and said drawer case while said locking bar and said lock are interconnected.

2. The combination according to claim 1 wherein said reciprocal motion is limited by a pair of spaced stops projecting from said locking bar and adapted to coact with a portion of said drawer case.

3. The combination according to claim 2 wherein spring means is connected between said locking bar and said drawer case urging said locking bar toward a closed position against a first of said spaced stops, said combinaton permitting said drawer when in a locked condition to be opened a limited distance against the action of said spring, said distance being limited by the other of said spaced stops.

4. The combination according to claim 3 wherein top means overlies said lock in the front panel of said drawer when said drawer is in said closed position, said lock being uncovered when said drawer is in said limited open position thereby rendering said lock accessible for purposes of unlocking said drawer.

5. In combination, a drawer, a drawer case and locking means for locking said drawer in said drawer case, said drawer case adapted for mounting to the underside of a work surface, said drawer including a front panel and a body portion, said body portion constructed and arranged to be slidably received in said drawer case and said drawer front panel adapted to underlie said work surface when said drawer is in a fully closed position, said locking means including a locking bar mounted to said drawer case for limited reciprocal movement therewith and a lock in the inner surface of said drawer front panel, whereby when said locking bar and said lock are engaged and said drawer is in its fully closed position said lock underlies said work surface, said drawer being movable to a lock exposed position while said locking bar and said lock remain engaged through the limited reciprocal movement of said locking bar.

6. The combination according to claim 5 wherein spring means interconnects said locking bar and said case, said spring means urging said locking bar inwardly with respect to said case.

7. The combination according to claim 5 wherein said locking bar includes a pair of spaced stop members thereon, said pair of spaced stop members coacting with a portion of said case to limit the extent of reciprocal movement of said locking bar with respect to said case.

8. In combination, a drawer case and drawer adapted for mounting to the underside of a work surface, said drawer case comprising; at least a pair of spaced side walls having guide rails on the inner surface thereof, and a locking mechanism support bar interconnecting said side walls adjacent the front ends thereof; said drawer comprising; a drawer front panel and a drawer body having external side rails constructed and arranged to ride on the guide rails on said side walls and lock means mounted on the inner side of said drawer front panel adjacent the top edge thereof; and a lock bar guide mounted to the underside of said locking mechanism support bar, a traveling lock bar mounted in said lock bar guide for reciprocating movement therein, said traveling lock bar including a front stop and a back stop and a pair of lock engaging projections on the forward end thereof; and spring means connected to said traveling lock bar and urging said front stop against said lock bar guide whereby said drawer, when said lock engaging projections are locked into said lock means of said drawer front panel, can be moved from a closed position to a slightly open position while remaining locked.

* * * * *